US008739656B2

(12) United States Patent
Gallato et al.

(10) Patent No.: US 8,739,656 B2
(45) Date of Patent: Jun. 3, 2014

(54) BOAT DRIVE COMPRISING AUXILIARY DRIVES

(75) Inventors: Fernando Gallato, Padua (IT); Daniele Sacchi, Padua (IT); Adone Bertolo, Padua (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 342 days.

(21) Appl. No.: 13/145,606

(22) PCT Filed: Feb. 1, 2010

(86) PCT No.: PCT/EP2010/051153

§ 371 (c)(1),
(2), (4) Date: Jul. 21, 2011

(87) PCT Pub. No.: WO2010/094549

PCT Pub. Date: Aug. 26, 2010

(65) Prior Publication Data

US 2012/0017712 A1 Jan. 26, 2012

(30) Foreign Application Priority Data

Feb. 18, 2009 (DE) ..... 10 2009 000 992

(51) Int. Cl.
*B63H 23/10* (2006.01)

(52) U.S. Cl.
USPC ..... 74/665 A; 74/665 C; 440/75

(58) Field of Classification Search
USPC ..... 74/665 A, 665 C; 440/75
See application file for complete search history.

(56) References Cited

U.S. PATENT DOCUMENTS

| | | | | |
|---|---|---|---|---|
| 2,708,416 | A * | 5/1955 | Schmitter | 440/4 |
| 3,025,823 | A * | 3/1962 | Tenney | 440/4 |
| 3,583,357 | A * | 6/1971 | Shimanckas | 440/52 |
| 5,024,639 | A | 6/1991 | Crispo | |
| 6,478,646 | B1 | 11/2002 | Fukuoka et al. | |
| 6,688,924 | B2 | 2/2004 | Marsland et al. | |
| 7,147,523 | B2 | 12/2006 | Mori et al. | |
| 7,862,393 | B2 | 1/2011 | Levander et al. | |
| 2008/0166934 | A1 | 7/2008 | Levander et al. | |

FOREIGN PATENT DOCUMENTS

| | | |
|---|---|---|
| DE | 1 269 000 | 5/1968 |
| DE | 690 10 363 T2 | 5/1995 |

(Continued)

OTHER PUBLICATIONS

Japanese Office Action issued in corresponding Japanese Patent Application No. 2011-549512 mailed on Feb. 4, 2014.

*Primary Examiner* — Ha D Ho
(74) *Attorney, Agent, or Firm* — Davis & Bujold, PLLC; Michael J. Bujold

(57) ABSTRACT

A pivotal boat drive having a transmission unit (1) which is driven by a drive engine via a connection point (A). The connection point has an input shaft (11) of a drive device (10) that is rotatably positioned around a first rotational axis (5) and an output shaft (3) that is coupled with the input shaft (11) and rotatable around a second rotational axis (6). The rotational axes (5, 6) are neither parallel nor concentrically positioned with respect to one another. At least one additional connection point (B, C) is provided at the transmission unit (1), at which an additional drive device (20), driven by an additional drive engine, can be positioned to drive the output shaft (3).

11 Claims, 2 Drawing Sheets

(56) References Cited

FOREIGN PATENT DOCUMENTS

| | | | |
|---|---|---|---|
| DE | 699 33 288 | T2 | 4/2007 |
| EP | 0 132 220 | A1 | 1/1985 |
| EP | 1 426 287 | A1 | 6/2004 |
| EP | 1 259 423 | B1 | 8/2004 |
| JP | S5863598 | A | 4/1983 |
| JP | 2008532838 | A | 8/2008 |
| WO | 2006/095042 | A1 | 9/2006 |

* cited by examiner

BOAT DRIVE COMPRISING AUXILIARY DRIVES

This application is a National Stage completion of PCT/EP2010/051153 filed Feb. 1, 2010, which claims priority from German patent application serial no. 10 2009 000 992.2 filed Feb. 18, 2009.

FIELD OF THE INVENTION

The present invention relates to a boat drive to steer and drive a.

BACKGROUND OF THE INVENTION

Known are so called Pod-Drives for boats, which are also referred to as pivoting boat drives or a rudder propeller. Such boat drives, for simultaneously steering and driving a boat, have a transmission unit inside the hull and a steering unit below the hull in the water. At least one propeller is pivotally positioned at the steering unit and is driven by a propeller shaft which is rotatably positioned within the steering housing. The steering unit pivots around its vertical axis to steer the boat, mainly, pivoting in parallel to the vertical axis of the boat. The transmission unit is coupled to a drive motor via a drive shaft. The drive motor is, like the transmission unit, positioned inside of the hull. An angle drive is positioned in the transmission unit to transfer the drive power down to the propeller shaft. In the angle drive, or in an optional gear ratio step, reversal of the rotational speed or torque, respectively, is possible as is reversal of the shaft rotation. The transmission units in the state of the art have just one shaft connection which is connected with the drive shaft or the engine, respectively. If an additional drive motor shall drive the propeller, as it is required for instance in a hybrid drive in which an additional electrical motor needs to be provided as an alternative drive motor, the transmission unit requires hereby a so-called auxiliary drive. The advantage of the electric motor in a hybrid drive is its possible application in areas of operation where noise and/or exhaust gases are to be limited or in lower speed mode operation such as a slow ride or when maneuvering during docking or takeoff.

In the following, an auxiliary drive needs to be understood as a technical device which allows the connection to an additional drive motor and the transfer of the input power to an output or output shaft, respectively. Also, it makes sense in certain cases of application to have a configuration with two different drive motor sizes, whereby the more powerful drive motor operates in a first operating range with a high power demand, for instance at high speeds or tensile loads, and where the lower power drive motor operates at lower load. Through the alternative operation of several engines, each can be operated using its best efficiency.

The DE 69933288 T2 shows a pivoting boat drive which, however, cannot be driven by means of an alternative drive motor. To create an auxiliary drive, a new transmission unit needs to be constructed or the existing transmission unit needs to be redesigned or altered. A hybridization of an existing boat drive in the described art is therefore only possible with significant effort.

The EP 1259423 B1 shows a two-engine boat drive configuration. Hereby, a boat transmission has two input shafts for each drive motor. The input shafts can be coupled selectively with the propeller shaft by means of several clutches, or they can drive the propeller shaft together. Even when the operation of the boat drive requires just one drive motor, both input shafts are present in the transmission, meaning that the transmission construction is more sophisticated than it is required which is noticeable through higher cost or installation effort, respectively, and weight. To the contrary, if the transmission is designed with one drive that is to be driven by just one drive motor, the second, unused input shaft can be omitted during the installation of the transmission. If the boat drive, however, needs to be altered to a two-engine operation, significant modification is hereby required. In addition, the described transmission is not suited for a pivoting boat drive because angular deflection the power shafts, which is required for a rudder propeller, is not provided here.

SUMMARY OF THE INVENTION

It is the task of this invention to create a boat drive which is designed as a rudder propeller, were its transmission unit can be altered in a simple way, to be capable of being driven by at least one additional drive motor.

A pivoting boat drive which is designed as a rudder propeller comprises of a transmission unit, which is inside the boat hull, and a steering unit outside of the boat hull. In the transmission unit, an input shaft which can be driven by a main engine is positioned at a connection point to rotate around a first rotational axis. An output shaft, which is coupled with the input shaft, is positioned to rotate around a second rotational axis. The rotation axes are neither parallel nor concentrically positioned with respect to each other. Hereby, at least an additional connection point is provided with the transmission unit at which an additional drive device, which can be driven by an additional driving engine, is positioned to drive the output shaft. It is possible, by means of the optional, additional drive, for the output shaft to provide additional driving engines, as they are required to create a hybrid drive, whereby an additional electric motor is required. Also, the additional drive alternative enables the configuration of a main engine for a larger load range and a smaller drive engine for a lower load range, whereby both drive engines can be operated in their respective operating range within the best efficiency range.

In a continuation of the inventive matter, the drive device in each case comprises an input shaft with parts for adaptation to a drive engine and bearing parts for the pivotal support of the input shaft.

It can also be provided that an input shaft of a two-part drive device is positioned coaxially to the output shaft and is connected with it in a rotationally fixed manner, and through which the output shaft is supported by means of the bearing center of the second drive device. Since the output shaft in a pivoting boat drive as in the state of the art, i.e., without the possibility for drive via an alternative driving engine, needs to have a bearing, additional effort for adapting to a drive engine is very low, because the auxiliary drive and the output shaft just need a common bearing. Thus, the creation of the options for the drive through an additional drive motor require an extremely small construction effort.

In addition, it is also possible that the input shaft of the first drive device is coupled with the output shaft by means of an angle drive which comprises of at least two bevel gear wheels.

It is also possible that the input shaft of an additional drive device is coupled with the output shaft by means of an angle drive.

In an alternative to the above embodiments, an input shaft of the additional drive device, as well as the input shaft of the first drive device, can rotate around the first rotational axis.

Preferably, the transmission unit comprises of a transmission housing which is designed with several inner contours as receptacles for the respective drive device.

In an especially preferred embodiment of the invention, the outer diameter of a bevel gear wheel of the drive device is smaller than the inner diameter of the respective inner contour of the transmission housing which is associated with the drive device. This condition enables the possibility of installing the drive devices in the transmission housing from the outside of the transmission unit. This has for instance the advantage that the drive devices can quickly be completed outside of the transmission unit and that the drive devices then can be inserted in a simple way into the transmission housing. Furthermore, it is not required to remove the transmission unit from the boat hull during an exchange of a drive device during maintenance or repair.

Preferred for the accommodation of the input shaft of the respective drive device are bearings which are positioned in a bearing bushing, wherein the bearing bushing can be positioned in the respective inner contour of the transmission housing. It is hereby possible to pre-assemble a drive device outside of the transmission unit.

Finally, it can be determined as advantageous that, in case of several, additional drive devices, the bearing parts, the input shafts, and the means for the adaptation of another driving engine are designed in the same way as for the second drive device. The advantage here is that the use of the same parts makes repair and installation easier and more economical.

BRIEF DESCRIPTION OF THE DRAWINGS

Examples of the embodiments of the invention are presented in the drawings and are further explained in the following.

These show.

DETAILED DESCRIPTION OF THE PREFERRED EMBODIMENTS

Figure 1:
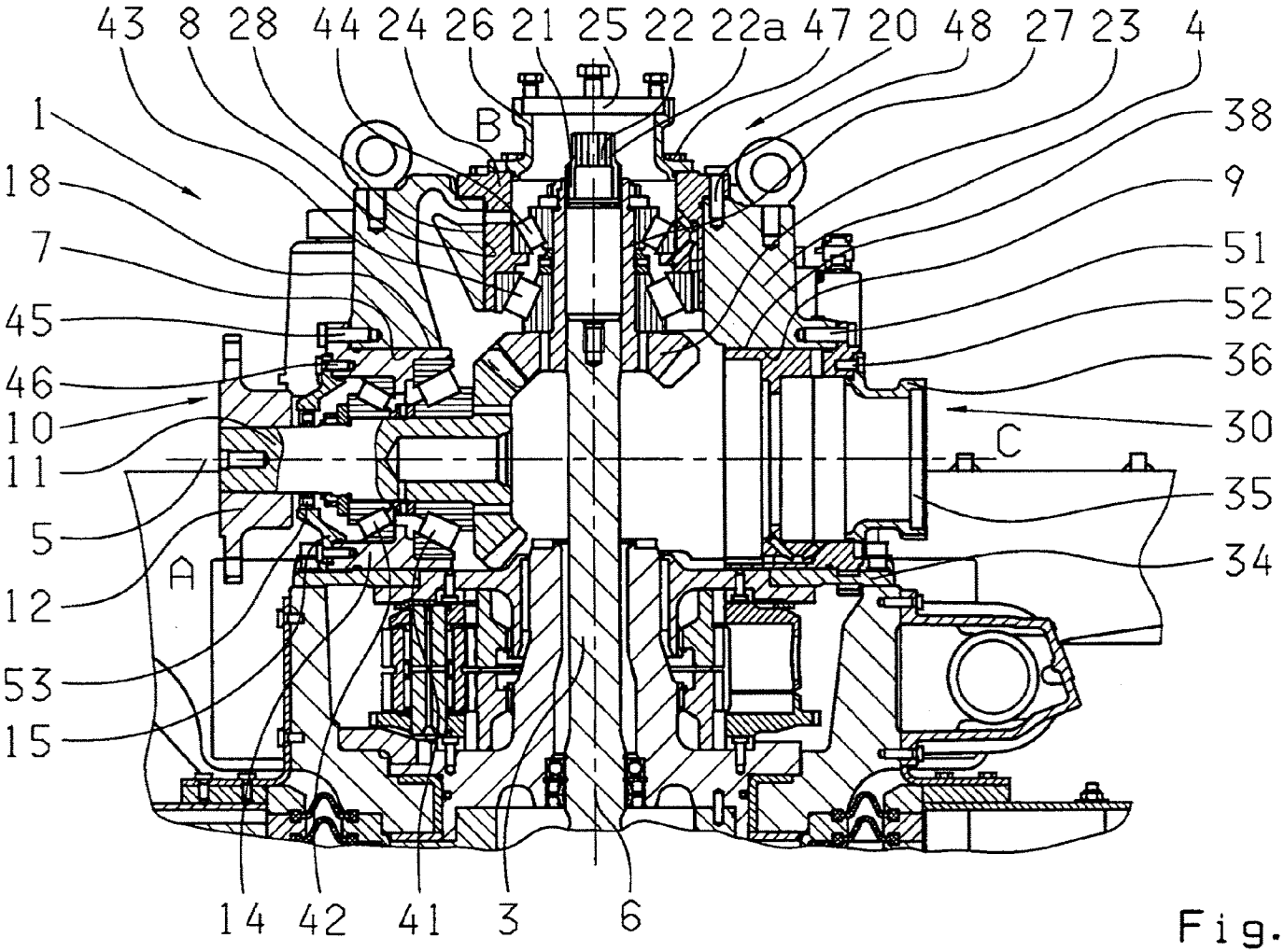
FIG. 1 a sectional view of a transmission unit of a boat drive.

FIG. 1 shows a section of a transmission unit 1. The section takes place in a plane which is defined by the rotational axis 5 of an input shaft 11 and a rotational axis 6 of an output shaft 3, wherein the rotational axis 5 is positioned in the longitudinal direction of the boat hull and is crossed by the rotational axis 6 at a right angle, and the rotational axis 6 extends perpendicular to the rotational axis 5. The transmission unit 1 is positioned inside of the boat hull. In a transmission housing 4 of the transmission unit 1, three connection points A, B, and C, are each designed to have a cylindrical inner contour 7, 8, and 9, wherein the inner contours 7 and 9 are arranged coaxial to the rotational axis 5 and the inner contour 8 is arranged coaxial to the rotational axis 6.

In the inner contour 7 and at the connection point A, a drive device 10 is positioned coaxial to the rotational axis 5. The drive power of a main drive motor is introduced into the transmission unit 1 at the connection point A, thus, the drive device 10 is also designated as a main drive. The drive device 10 comprises of a bearing bushing 14 with two tapered roller bearings 41 and 42, a flange 12, an input shaft 11, a cover 15, and a bevel gear 13.

The bearing bushing 14 has a cylindrical outer contour 18 which creates a form fit with the inner contour 7. Hereby, the bearing bushing 14 is positioned in the transmission housing 4 coaxial to the rotational axis 5. At an inner contour of the bearing bushing 14, the two tapered roller bearings 41 and 42 are positioned. The input shaft 11 is arranged in the tapered roller bearings 41 and 42 so as to rotate around the rotational axis 5. At a first end of the input shaft 11, a flange 12 is positioned outside of the transmission housing 4 and is connected with the input shaft 11 in a rotationally fixed manner. Via the flange 12, the input shaft 11 is connected to and driven by a drive shaft of a main drive motor (not shown).

Inside of the transmission housing 4, the bevel gear 13 is constructed at the second end of the input shaft 11 and is integrally formed with the input shaft 11. As an alternative, the bevel gear wheel 13 can also be designed as a separate part and be connected to the input shaft 11 in a rotationally fixed manner. Between the bearing bushing 14 and the flange 12, the cover 16 is positioned and secured, via several screws 46, to the bearing bushing 14 so as to be concentric to the rotational axis 5. Between the cover 15 and the input shaft 11, a radial shaft gasket ring 53 is fixed to the cover 15, through which the inner part of the transmission unit 1 is sealed against outside influences, such as for instance contamination, water, etc.

At the connection point B, a drive device 20 is positioned in the inner contour 8 of the transmission housing 4. The drive device 20 comprises of a hollow shaft 21, a shaft tappet 22, and a bearing bushing 24 with two tapered roller bearings 43 and 44, an adaptation flange 26 with a cover 29 and a bevel gear 23.

The bearing bushing 24, similar to the bearing bushing 14, is connected to the transmission housing 4 in a rotationally fixed manner by several screws 48 and has an outer contour 28, which forms a form fit with the inner contour 8 and is therefore, in reference to the rotational axis 6, centered in the transmission housing 4. The adaptation flange 26 is also coaxially positioned along the rotational axis 6 to the bearing bushing 24 and connected thereto by several screws 47. The hollow shaft 21 is positioned in the tapered roller bearings 43 and 44 so as to rotate about the rotational axis 6. At a first end of the hollow shaft 21, at an inner contour 27 of the hollow shaft 21, there is a shaft tappet 22 connected in a rotationally fixed manner with the hollow shaft 21. The shaft tappet 22 has gearing **22*a* at its outer contour. At the second end of the hollow shaft 21, the output shaft 3 is connected in a rotationally fixed manner with the hollow shaft 21 at the inner contour 27. Also, the second end of the hollow shaft 21 is designed as a bevel gear 23 such that the hollow shaft 21 and the bevel gear 23 form one part. As an alternative, the bevel gear wheel 23 can be separate and connected with the hollow shaft 21** in a rotationally fixed manner.

By means of the shaft tappet 22, the output shaft 3 can be driven by an additional drive motor, in addition to a drive motor which drives the input shaft 11, so that the drive device 20 forms an auxiliary drive.

Figure 2:
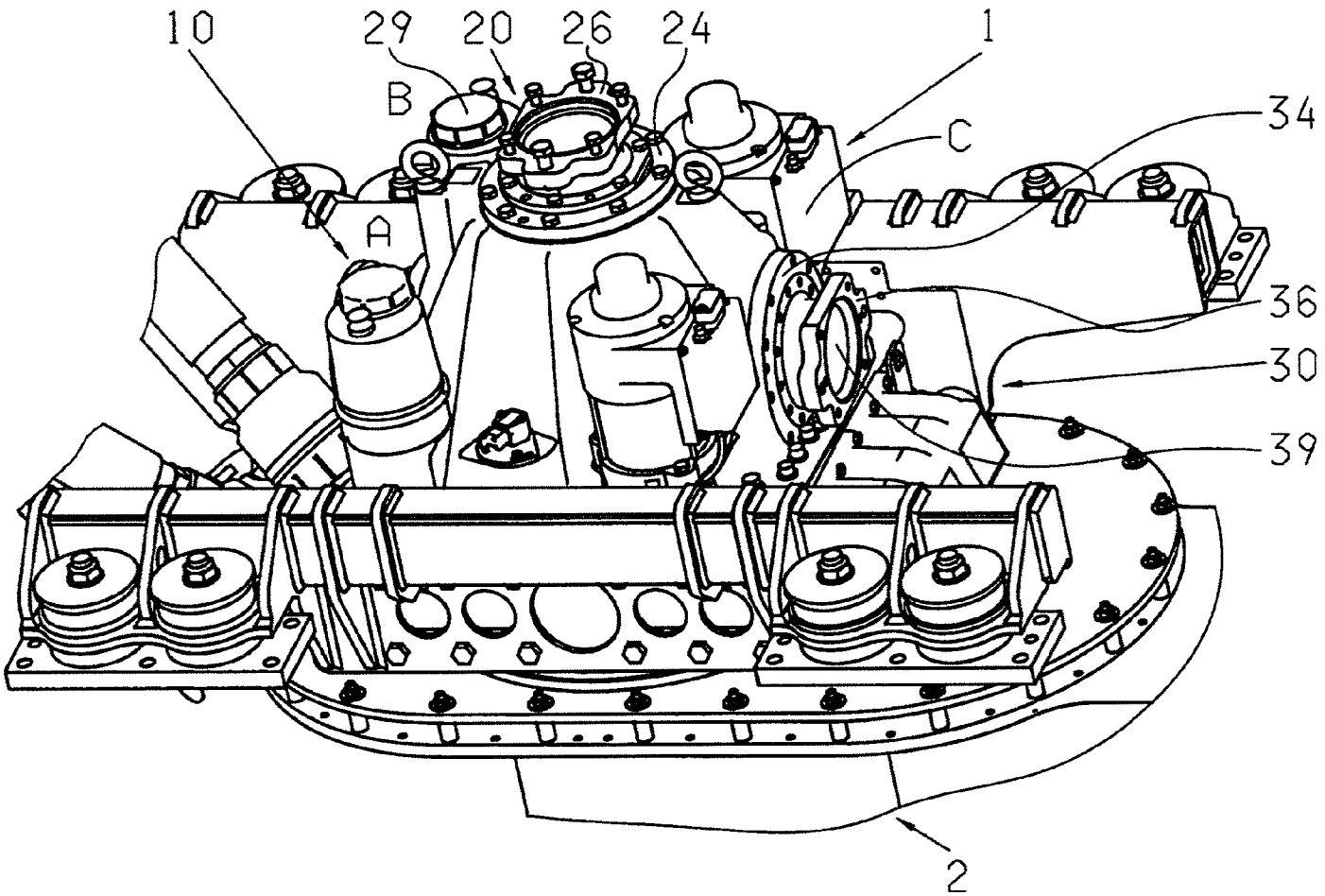
FIG. 2 a perspective view of a boat drive.

The vertical section of the additional drive train (not shown) is connected, fixed with the adaptation flange 26. A rotating, driving part (also not shown) of the additional drive train is, by means of a form fit with the gearing **22*a*, connected in a rotationally fixed manner with the shaft tappet 22. The output shaft 3 extends vertically downward into the steering unit, which is shown in FIG. 2, and drives, via an additional angle drive, the propeller shaft. To decouple the main drive motor and the second drive motor, clutches are needed, for instance, outside of the transmission unit 1** in the respective drive trains.

If no drive is provided to the transmission unit 1 by an additional drive motor, the adaptation flange 26 is closed up by the cover 29. The shaft tappet 22 no longer being needed at that time. If it is arranged in a rotationally fixed configuration, but is axially movable on the hollow shaft 21, the shaft tappet 22 can easily be removed.

Two functions are combined in the shown embodiment of the drive device 20, thus, the effort for adapting an additional drive train is minimal. On one hand, a bearing is required for the output shaft 3 in a transmission unit in accordance with the state of the art. In accordance with the invention, the output shaft 3, in the drive device 20, is positioned by means of the same hollow shaft 21 by which also the shaft tappet 22 is connected in a rotationally fixed manner. Herein, the drive device 20 is designed in a way so that the adaptation of an additional drive motor is simple. Just the adaptation flange 26 and the shaft tappet 22 are additionally required to construct the drive device 20 as an auxiliary drive.

FIG. 1 does not present an additional drive at the connection point C, thus, the drive device 30 neither comprises a bearing, nor a hollow shaft. In the shown drive device 30, a bearing bushing 34 with an outer contour 38 is form-fit in the inner contour 9 of the transmission housing 4 and connected with the transmission housing 4 in a rotationally fixed manner by means of several screws 51. The bearing bushing 34, as well as the bearing bushing 14, are positioned coaxial to the rotational axis 5. An adaptation flange 36 is connected in a rotationally fixed manner with the fixed mounted bearing bushing 34 by means of several screws 52. The adaptation flange 36 is closed by a cover 35.

Due to the advantageous, identical design of the bearing bushings 34 and 24, the tapered roller bearings, a hollow shaft with a bevel gear and a shaft tappet, can be positioned in the bearing bushing 34 in the same manner. Hereby, an auxiliary drive is also possible at the connection point C around the rotational axis 5, opposite to the input shaft 11. With the possibility of using the same parts in both drive devices 20 and 30, the installation and manufacturing effort would be reduced, wherein the drive device 20 is already positioned, even without an additional drive at the connection point B, except for the shaft tappet 22, in the transmission housing 4, because the output shaft 3 is positioned in the drive device 20.

Due to the two, possible connection points B and C for an additional drive, the installation of an additional drive motor is not limited to just one installation location, so that the ship builder can flexibly construct and position an additional drive motor, taking the different spatial conditions of different boats into consideration.

If the drive device 30 were to be constructed like the drive device 20, without a need for an additional drive to the transmission unit 1 at the connection point C, a bevel gear and therefore also the hollow shaft and the tapered roller bearing would idly run with the output shaft 3 which causes, for instance, losses in efficiency and also wear. Also, parts would be installed in the transmission unit 1 which are not required, and this is not desired, for instance, because of reasons of cost, needed installation effort, and weight.

To enable an easy installation of the drive devices 10, 20, and 30 in the transmission housing 4, the inner diameter of the inner contours 7, 8, and 9 are advantageously selected in a way that they are in each case larger than the largest outer diameter of the respective bevel gear 13 or 23. Thus, the entire drive device 10, 20 can be pre-assembled in the bearing bushing 14, 24, outside of the transmission unit 1.

Thereafter, the bearing bushing 14, 24 can be inserted with its installed parts into the transmission housing 4. The respective beveled gears are brought into engagement in a simple way. Thereafter, the respective bearing bushing is attached to the transmission housing by means of screws. With this, installation or exchange, respectively, of each drive device can take place without removing the transmission unit 1 from the boat hull. Theoretically, positioning of the bearings at the different connection points is possible, directly at the transmission housing 4, without the necessity of the respective bearing shell, however, it makes the installation of the drive devices into the transmission unit more difficult.

Thus, different drives are possible with the transmission unit 1 at three connection points A, B, and C, wherein respective clutches need to be provided in the different drive trains, outside of the transmission unit 1. To avoid dragging of a stopped engine, it needs to be decoupled from the transmission unit 1. To sum up the drive power of the drive motors, they must be coupled with the transmission unit 1.

At the connection points B and C, an output drive can take place by means of a respective drive device, meaning the drive of a device outside of the transmission unit 1.

FIG. 2 shows a perspective view of a boat drive of the described art, in which the transmission unit 1 and the respective configuration of the respective auxiliary drives can be seen. Also, the body of the steering unit 2, which is positioned outside of the hull, is shown. Viewed from the outside, the drive device 20 can be seen with the bearing bushing 24 and the adaptation flange 26, as well as the cover 29 and the respective screws. Also shown with the drive device 30 is the bearing bushing 34, and the adaptation flange 36, as well as the cover 35, and the respective screws. The drive device 10 with the input shaft 11 is not visible.

REFERENCE CHARACTERS

1 Transmission Unit
2 Control Unit
3 Output Shaft
4 Transmission Housing
5 Axis of Rotation
6 Axis of Rotation
7 Inner Contour
8 Inner Contour
9 Inner Contour
10 Drive Device
11 Input Shaft
12 Flange
13 Bevel Gear
14 Bearing Bushing
15 Cover
18 Outer Contour
20 Drive Device
21 Hollow Shaft
22 Shaft Tappet
22*a* Gearing
23 Bevel Gear
24 Bearing Bushing
25 Cover
26 Adaptation Flange
28 Outer Contour
30 Drive Device
34 Bearing Bushing
35 Cover
36 Adaptation Flange
38 Outer Contour
41 Tapered Roller Bearing
42 Tapered Roller Bearing
43 Tapered Roller Bearing
44 Tapered Roller Bearing
45 Screw
46 Screw
47 Screw
48 Screw
51 Screw

52 Screw
53 Radial Shaft Gasket Ring
A Connection point
B Connection point
C Connection point

The invention claimed is:

1. A pivotable boat drive comprising:

a transmission unit (1) having an input shaft (11) at a first connection point (A), and the input shaft (11) of a first drive device (10) being positioned, rotatable around a first rotational axis (5), and being drivable by a drive engine;

an output shaft (3) being coupled with the input shaft (11) and rotatable around a second rotational axis (6);

the first and the second rotational axes (5, 6) are neither parallel nor concentrically positioned with respect to one another;

the transmission unit (1) having second and third additional connection points (B, C) so that two additional drive devices (20), each driveable by an additional drive engine, can provide drive to the output shaft (3) of the transmission unit (1); and the transmission unit (1) thus having three different installation connection points (A, B, C) at which different drives can provide drive to the output shaft (3), the boat drive being pivotable about a pivot axis.

2. The boat drive according to claim 1, wherein the drive device (10, 20) comprises the input shaft (11, 21) with parts for an adaptation (12, 22, 26) to the drive engine and bearing parts (14, 41, 42, 24, 43, 44) for bearing of the input shaft (11, 21).

3. The boat drive according to claim 2, wherein an input shaft (21) of a second drive device (20) is coaxially positioned with reference to the output shaft (3) and connected with the output shaft (3) in a rotationally fixed manner, and the output shaft (3) is supported by the bearing parts (24, 43, 44) of the second drive device (20).

4. The boat drive according to claim 2, wherein the input shaft (11) of the first drive device is coupled with the output shaft (3) by an angle drive which comprises at least two bevel gears (13, 23).

5. The boat drive according to claim 1, wherein an input shaft of a further additional drive device is coupled with the output shaft (3) by an angle drive, the input shaft of the first drive device comprises a bevel gear that is rotationally fixed thereto and the output shaft comprises a bevel gear that is rotationally fixed thereto, and the bevel gear of the input shaft of the first drive device engages and drives the bevel gear of the output shaft.

6. The boat drive according to claim 5, wherein the input shaft of the further additional drive device is rotatable around the first rotational axis (5).

7. The boat drive according to claim 2, wherein the transmission unit (1) comprises a transmission housing (4) with a plurality of inner contours (7, 8, 9) which each are designed as a receptacle for accommodating a respective drive device (10, 20, 30).

8. The boat drive according to claim 4, wherein an output diameter of a bevel gear (13, 23) of a drive device (10, 20) is smaller than an inner diameter of a respective inner contour (7, 8) of the transmission enclosure (4) which is assigned to the drive device.

9. The boat drive according to claim 7, wherein each bearing (41, 42, 43, 44), for supporting the input shaft (11, 21) of the respective drive device (10, 20), is positioned in a bearing bushing (14, 24), and the bearing bushing is positioned in the respective inner contour (7, 8, 9) of the transmission enclosure (4).

10. The boat drive according to claim 3, wherein for each additional drive device, the bearing part (43, 44), the input shaft (21), and the part for the adaptation (22, 26) to an additional drive engine are designed as the second drive device (20).

11. A transmission unit (1) of a pivotable boat drive, the transmission unit (1) comprising:

a first connection point (A) for connecting a drive motor to the transmission unit (1), the first connection point (A) comprising a drive device (10) with an input shaft (11) that is that is supported adjacent the first connection point (A) by a bearing for rotation about a first rotational axis (5);

the input shaft (11) being rotationally fixed to a first bevel gear (13);

a second connection point (B) for connecting an additional drive motor to the transmission unit (1), the second connection point (B) comprising a drive device (20) with a hollow shaft (21) that is rotatably supported at the second connection point (B) by a bearing for rotation about a second rotational axis (6);

the hollow shaft (21) being rotationally fixed to a second bevel gear (23), the hollow shaft (21) being drivable by the additional drive motor;

an output shaft (3) being coaxially supported within and rotationally fixed to the hollow shaft (21);

the first bevel gear (13) engaging the second bevel gear (23) for transmitting drive from the input shaft (11) to the output shaft (3); and a third connection point (C) for connecting a further drive motor to the transmission unit (1), the third connection point (C) comprising a drive device (30) that is axially aligned along the first rotational axis (5), and the first rotational axis (5) is neither parallel to nor concentrically aligned with the second rotational axis (6).

* * * * *